US007896469B2

(12) United States Patent
Furukawa

(10) Patent No.: US 7,896,469 B2
(45) Date of Patent: Mar. 1, 2011

(54) HEAD SUBSTRATE, PRINTHEAD, HEAD CARTRIDGE, AND PRINTING APPARATUS

(75) Inventor: Tatsuo Furukawa, Zama (JP)

(73) Assignee: Canon Kabushiki Kaisha, Tokyo (JP)

( * ) Notice: Subject to any disclaimer, the term of this patent is extended or adjusted under 35 U.S.C. 154(b) by 758 days.

(21) Appl. No.: 11/947,186

(22) Filed: Nov. 29, 2007

(65) Prior Publication Data

US 2008/0129781 A1 Jun. 5, 2008

(30) Foreign Application Priority Data

Dec. 5, 2006 (JP) ..... 2006-328852

(51) Int. Cl.
*B41J 2/14* (2006.01)

(52) U.S. Cl. ..... 347/50

(58) Field of Classification Search ..... 347/50, 347/57, 58

See application file for complete search history.

(56) References Cited

U.S. PATENT DOCUMENTS

| | | | | |
|---|---|---|---|---|
| 6,290,334 | B1 | 9/2001 | Ishinaga et al. | |
| 6,474,782 | B1 * | 11/2002 | Furukawa | 347/50 |
| 6,712,437 | B2 | 3/2004 | Furukawa et al. | |
| 6,824,237 | B2 | 11/2004 | Hirayama et al. | |
| 7,133,153 | B2 | 11/2006 | Furukawa | |
| 7,287,832 | B2 * | 10/2007 | Hayasaki | 347/50 |
| 7,321,444 | B2 | 1/2008 | Hirayama | |
| 7,354,125 | B2 | 4/2008 | Hirayama et al. | |
| 7,354,139 | B2 * | 4/2008 | Hirayama | 347/57 |
| 7,549,734 | B2 * | 6/2009 | Imanaka et al. | 347/58 |
| 2005/0134620 | A1 | 6/2005 | Hirayama et al. | |
| 2006/0284909 | A1 | 12/2006 | Kasai et al. | |
| 2007/0002340 | A1 | 1/2007 | Furukawa | |
| 2008/0129791 | A1 | 6/2008 | Furukawa et al. | |

FOREIGN PATENT DOCUMENTS

| | | | |
|---|---|---|---|
| JP | 2006-88648 | A | 4/2006 |
| WO | 2006/009235 | A1 | 1/2006 |

* cited by examiner

*Primary Examiner* — Anh T. N. Vo

(74) *Attorney, Agent, or Firm* — Fitzpatrick, Cella, Harper & Scinto

(57) ABSTRACT

The objective of this invention is to provide a head substrate capable of increasing the layout efficiency by arranging circuit elements in a free area of the head substrate on which ink supply channels are staggered. More specifically, the circuit elements connected to a plurality of element arrays are arranged on the free area.

15 Claims, 19 Drawing Sheets

HEAD SUBSTRATE, PRINTHEAD, HEAD CARTRIDGE, AND PRINTING APPARATUS

BACKGROUND OF THE INVENTION

1. Field of the Invention

The present invention relates to a head substrate, printhead, head cartridge, and printing apparatus. Particularly, the present invention relates to a head substrate prepared by forming, on the same substrate, an electrothermal transducer for generating heat energy necessary to print, and a driver circuit for driving the electrothermal transducer, a printhead using the head substrate, a head cartridge using the printhead, and a printing apparatus.

2. Description of the Related Art

The electrothermal transducers (heaters) and driver circuits of a printhead mounted in a conventional inkjet printing apparatus are formed on the same substrate by a semiconductor process technique as disclosed in, for example, U.S. Pat. No. 6,290,334. There has already been proposed a substrate on which an ink supply channel for supplying ink is arranged on the substrate and heaters are arrayed at positions opposite to each other near the ink supply channel.

FIG. 6 is a view showing the layout of a head substrate used in a conventional inkjet printhead. As a method of driving a printhead of this type, time-divisional driving is put into practical use. A maximum power capable of simultaneously driving heaters has an upper limit. According to the time-divisional driving, a plurality of heaters are divided into M heater blocks each of N heaters, and N heaters of each heater block are simultaneously driven.

In FIG. 6, a substrate 100 is formed by integrating, by a semiconductor process technique, heaters and driver circuits for driving them. A heater & driver array 101 is an array of heaters and drivers. The driver includes a driver transistor which serves as a driving element. An ink supply channel 102 supplies ink from the back surface of the substrate. Each shift register (S/R) 103 temporarily stores print data. Each latch circuit 104 latches print data stored in the corresponding shift register (S/R) 103 at once. Each decoder 105 selects a desired heater block of the heater & driver array 101. Each input circuit block 106 includes a buffer circuit for inputting digital signals to the shift register 103 and decoder 105. The decoder receives a block selection signal as a control signal. Signal lines 107 transmit signals from the shift register 103 and decoder 105 to select individual segments in the heater & driver array 101. Each contact pad 110 is used to input/output an electrical signal from/to outside the substrate.

FIG. 7 is a circuit diagram showing an equivalent circuit corresponding to one segment (one heater) of the heater & driver array 101 which are integrated on the head substrate shown in FIG. 6 and drive heaters for discharging ink.

In a head substrate layout as shown in FIG. 6, the contact pads 110, input circuit blocks 106, decoders 105, shift registers 103, and latch circuits 104 are arranged at the ends of the head substrate 100 in a longer side direction. In this layout, the signal lines 107 are provided along the longer side direction of the head substrate 100.

In FIG. 7, an AND circuit 201 calculates the logical product of two input signals. The AND circuit 201 receives a block selection signal which is sent from the decoder 105 to select heaters of each block, and a print data signal which is transferred to the shift register 103 and latched by the latch circuit 104. Based on the logical product, each segment can be selectively turned on. An inverter circuit 202 buffers an output from the AND circuit 201. A VDD power supply line 203 serves as the power supply of the inverter circuit 202. An inverter circuit 204 buffers an output from the inverter circuit 202. A VH power supply line 205 is used for supplying a voltage to be applied to a heater. A driver transistor 207 serves as a switching element for switching between supplying a current and not supplying the current, to a heater 206. A VHTM power supply line 208 serves as a power supply for supplying power to the inverter circuit 204 functioning as a buffer, thereby applying a gate voltage to the driver transistor 207. A voltage conversion circuit 209 converts the voltage of an output signal from the AND circuit 201 into a voltage VHTM for driving the driver transistor 207. The voltage conversion circuit 209 incorporates a level converter 210 which converts a voltage to the voltage VHTM.

FIG. 8 is an equivalent circuit diagram of a circuit corresponding to one bit of the shift register 103 and latch circuit 104 which temporarily store print data.

In FIG. 8, print data DATA is input to the shift register in synchronism with a clock CLK, and the input print data is latched in synchronism with a latch signal LT. When a heat enable signal HE is input, a print data signal is output from the latch circuit to the AND circuit 201 while the heat enable signal is enabled.

FIG. 9 is a timing chart for explaining a series of operations from receiving print data in the shift register 103 to driving the heater 206 by supplying a current to it.

In FIG. 9, print data is supplied to a data pad (not shown) in synchronism with the clock CLK input to a clock pad (not shown). The shift register 103 temporarily stores the print data. The latch circuit 104 latches the print data in synchronism with the latch signal LT supplied to a latch pad (not shown). Then, the logical product of a block selection signal for selecting heaters of a desired block, and a print data signal held in accordance with the latch signal LT is calculated. A heater current (current VH) flows in synchronism with the heat enable signal HE, which directly determines a current driving time, and the logical product.

Printing is performed by repeating the series of operations for respective blocks.

FIG. 10 is a view showing connection of power supply wiring lines in the head substrate shown in FIG. 6.

In FIG. 10, power supply pads VH 130, 132, 134, and 136 supply voltages to be applied to heaters. Ground pads GND 131, 133, 135, and 137 correspond to the power supply pads. Wiring lines 140 are divided to independently supply power from the power supply pads VH to respective blocks. Wiring lines 141 are divided to feed back power from the blocks to the ground pads GND. These wiring lines will be called VH power supply wiring lines and GND wiring lines.

Segments including heaters and driver transistors arranged on the head substrate are divided into 16 groups A to P. Power is independently supplied and fed back to and from each group in order to keep power loss constant by making uniform the wiring resistances of the VH power supply wiring lines and GND wiring lines which are connected to the respective groups. The widths of the wiring lines are adjusted to have the same resistance value. Each group is comprised of segments (including heaters), respectively belonging to different time-divisionally driven blocks.

A head substrate on which ink supply channel arrays are staggered is proposed in, e.g., Japanese Patent Publication Laid-Open No. 2006-88648.

However, according to the power supply wiring connection as shown in FIG. 10, the wiring becomes longer as the longer side of the chip (head substrate) becomes longer. In addition, as the group division count increases, the widths of wiring lines independently connected to respective groups become narrower, and the wiring resistance tends to rise as a whole.

The increase in wiring resistance causes so-called power loss because power, which should be originally consumed by heaters, is consumed by the wiring to a certain degree. If the original power supply voltage is increased to compensate for the power loss, this adversely affects the durable service life of heaters. Further, heat generated by power consumption by the wiring raises the temperature of the printhead itself, adversely affecting the ink discharge characteristic.

As for a head substrate on which ink supply channel arrays are staggered, the above reference (Japanese Patent Publication Laid-Open No. 2006-88648) does not disclose a specific layout of circuits on the head substrate. A circuit layout effectively utilizing a head substrate with a limited area is required.

SUMMARY OF THE INVENTION

Accordingly, the present invention is conceived as a response to the above-described disadvantages of the conventional art.

For example, a head substrate according to this invention is capable of increasing the layout efficiency, reducing power loss, and reducing the substrate area by effectively utilizing the area of a head substrate on which ink supply channels are staggered.

According to one aspect of the present invention, preferably, there is provided a rectangular head substrate used in an inkjet printhead having a printing element array of printing elements which print by discharging supplied ink, and a driving element array of driving elements which drive the printing elements, the head substrate comprising: a plurality of ink supply channels having a predetermined length along a longer side direction of the head substrate; a plurality of element arrays which are arranged on at least one side of each of the plurality of ink supply channels, and each of which has the printing element array and the driving element array; and a signal line which is provided along the longer side direction of the head substrate and transmits a signal to the plurality of element arrays, wherein the element arrays and the signal line are provided in an order named from the plurality of ink supply channels toward a longer side of the head substrate, plural pairs of the ink supply channels and the element arrays corresponding to the respective ink supply channels are arrayed in a staggered manner in the longer side direction of the head substrate, and another building element, of the head substrate, electrically connected to two adjacent element arrays is arranged in an area surrounded by the signal line and every other element array out of the plurality of element arrays arranged in the staggered manner.

According to another aspect of the present invention, preferably, there is provided a printhead using a head substrate described above.

According to still another aspect of the present invention, preferably, there is provided a head cartridge integrating the above printhead and an ink tank containing ink to be supplied to the printhead.

According to still another aspect of the present invention, preferably, there is provided a printing apparatus using the above printhead.

The invention is particularly advantageous since a power supply pad is arranged in an area formed when ink supply channels and corresponding element arrays are staggered, and the power supply pad supplies power to an element array adjacent to the power supply pad. The area can be effectively utilized, and the distance between the pad and the element array can be shortened. Hence, the wiring resistance for power supply can be suppressed to reduce power loss.

Since the area which is free on a conventional head substrate can be effectively utilized, the head substrate can be efficiently utilized, contributing to downsizing the head substrate.

Since the power supply line need not be made thick, the layout area can be reduced, contributing to downsizing the head substrate.

Further features of the present invention will become apparent from the following description of exemplary embodiments (with reference to the attached drawings).

BRIEF DESCRIPTION OF THE DRAWINGS

FIG. 4A is an equivalent circuit diagram showing the detailed arrangement of a group 101G including a heater array, driver array, and the like;

DESCRIPTION OF THE EMBODIMENTS

Figure 1:
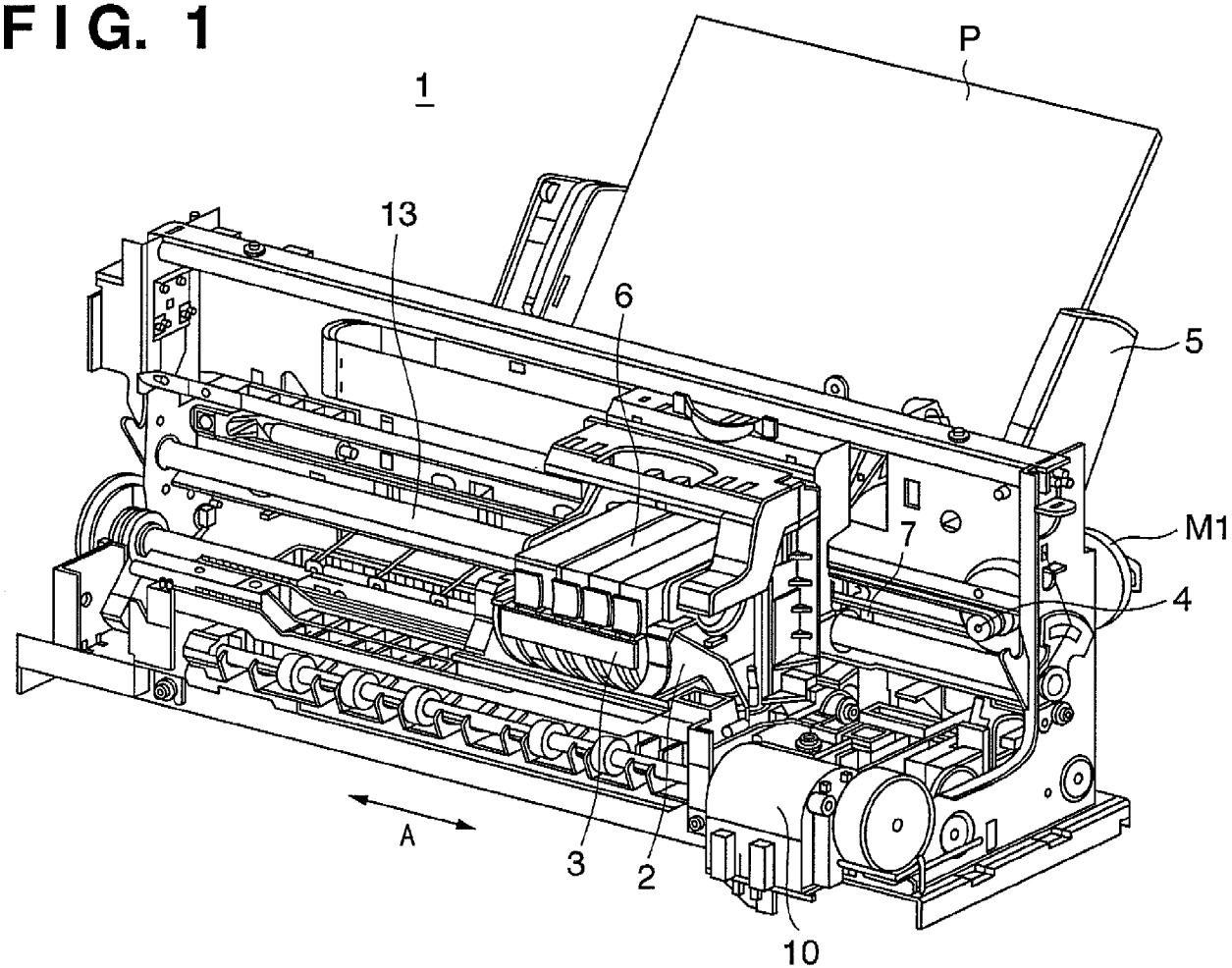
FIG. 1 is a schematic perspective view showing the outer appearance of the structure of an inkjet printing apparatus as a typical embodiment of the present invention.

Preferred embodiments of the present invention will now be described in detail in accordance with the accompanying drawings. The same reference numerals denote the same parts, and a description thereof will not be repeated.

In this specification, the terms "print" and "printing" not only include the formation of significant information such as characters and graphics, but also broadly includes the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be extensively interpreted similar to the definition of "print" described above. That is, "ink" includes a liquid which, when applied onto a print medium, can form images, figures, patterns, and the like, can process the print medium, and can process ink (e.g., can solidify or insolubilize a coloring agent contained in ink applied to the print medium).

The term "printhead substrate (head substrate)" in the description not only includes a simple substrate made of a silicon semiconductor, but also broadly includes a substrate with elements, wiring lines, and the like.

The expression "on a substrate" not only includes "on an element substrate", but also broadly includes "on the surface of an element substrate" and "inside of an element substrate near its surface". The term "built-in" in the present invention not only includes "simply arrange separate elements on a substrate surface", but also broadly includes "integrally form and manufacture elements on an element substrate by a semiconductor circuit manufacturing process or the like".

<Description of Inkjet Printing Apparatus (FIG. 1)>

FIG. 1 is a schematic perspective view showing the outer appearance of the structure of an inkjet printing apparatus 1 as a typical embodiment of the present invention.

In the inkjet printing apparatus (to be referred to as a printing apparatus hereinafter), as shown in FIG. 1, a carriage 2 supports a printhead 3 for printing by discharging ink according to the inkjet method. A transmission mechanism 4 transmits a driving force generated by a carriage motor M1 to the carriage 2, and the carriage 2 can reciprocate in directions indicated by an arrow A. In printing, a print medium P such as print paper is fed via a paper feed mechanism 5 and conveyed to a print position. At the print position, the printhead 3 prints by discharging ink to the print medium P.

To maintain a good state of the printhead 3, the carriage 2 moves to the position of a recovery device 10. The recovery device 10 intermittently performs a discharge recovery operation for the printhead 3.

The carriage 2 of the printing apparatus 1 supports not only the printhead 3, but also an ink cartridge 6 which contains ink to be supplied to the printhead 3. The ink cartridge 6 is detachable from the carriage 2.

The printing apparatus 1 shown in FIG. 1 can print in color. For this purpose, the carriage 2 supports four ink cartridges which respectively contain magenta (M), cyan (C), yellow (Y), and black (K) inks. The four ink cartridges are independently detachable.

The carriage 2 and printhead 3 can achieve and maintain a predetermined electrical connection by properly bringing their contact surfaces into contact with each other. The printhead 3 selectively discharges ink from a plurality of orifices and prints by applying energy in accordance with print data. In particular, the printhead 3 according to the embodiment employs an inkjet method of discharging ink by using heat energy. For this purpose, the printhead 3 comprises an electrothermal transducer for generating heat energy. Electric energy applied to the electrothermal transducer is converted into heat energy. Ink is discharged from orifices by using a change in pressure upon growth and shrinkage of bubbles due to film boiling generated by applying the heat energy to ink. The electrothermal transducer is arranged in correspondence with each orifice, and ink is discharged from a corresponding orifice by applying a pulse voltage to a corresponding electrothermal transducer in accordance with print data.

As shown in FIG. 1, the carriage 2 is coupled to part of a driving belt 7 of the transmission mechanism 4 which transmits the driving force of the carriage motor M1. The carriage 2 is slidably guided and supported along a guide shaft 13 in the directions indicated by the arrow A. The carriage 2 reciprocates along the guide shaft 13 by normal rotation and reverse rotation of the carriage motor M1.

The printing apparatus 1 has a platen (not shown) facing the orifice surface of the printhead 3 having orifices (not shown). The carriage 2 supporting the printhead 3 reciprocates by the driving force of the carriage motor M1. At the same time, the printhead 3 receives print data to discharge ink and print on the entire width of the print medium P conveyed onto the platen.

<Control Arrangement of Inkjet Printing Apparatus (FIG. 2)>

Figure 2:
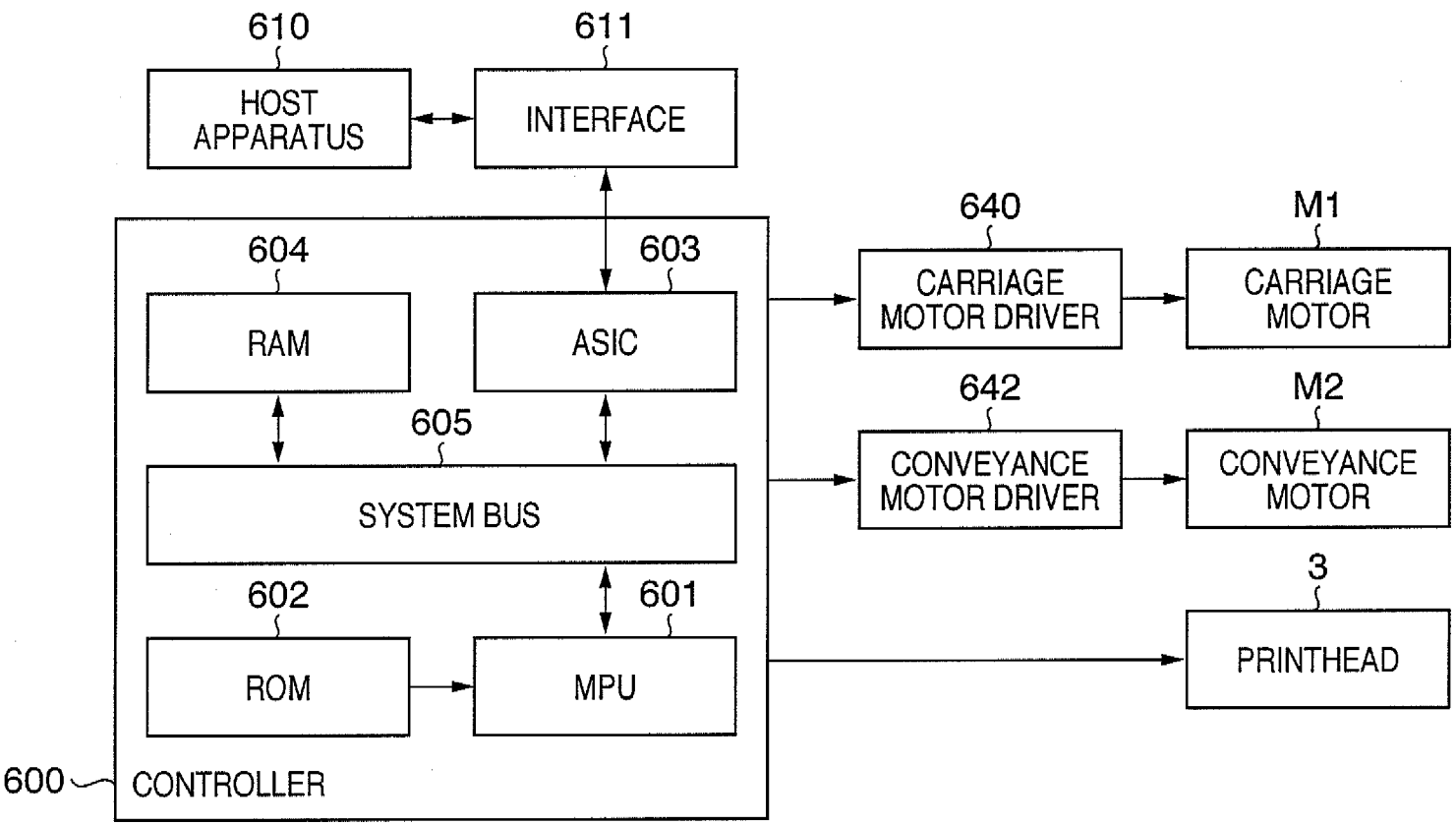
FIG. 2 is a block diagram showing the arrangement of the control circuit of the printing apparatus.

FIG. 2 is a block diagram showing the control arrangement of the printing apparatus shown in FIG. 1.

As shown in FIG. 2, a controller 600 comprises a MPU 601, ROM 602, ASIC (Application Specific Integrated Circuit) 603, RAM 604, and system bus 605. The ROM 602 stores a program corresponding to a control sequence, a predetermined table, and other permanent data. The ASIC 603 generates control signals for controlling the carriage motor M1, a conveyance motor M2, and the printhead 3. The RAM 604 is used as an image data expansion area, a work area for executing a program, and the like. The system bus 605 connects the MPU 601, ASIC 603, and RAM 604 to each other, and allows exchanging data.

In FIG. 2, a computer (or an image reader, digital camera, or the like) 610 serves as an image data source and is generally called a host apparatus. The host apparatus 610 and printing apparatus 1 transmit/receive image data, commands, status signals, and the like via an interface (I/F) 611.

A carriage motor driver 640 can drive the carriage motor M1 for reciprocating the carriage 2 in the directions indicated by the arrow A. A conveyance motor driver 642 drives the conveyance motor M2 for conveying the print medium P.

The ASIC 603 transfers print data DATA of a printing element (heater for ink discharge) to the printhead while directly accessing the storage area of the RAM 604 in printing and scanning by the printhead 3.

The ink cartridge 6 and printhead 3 is separable from each other, as described in FIG. 1, but may also be integrated into an exchangeable head cartridge.

Figure 3:
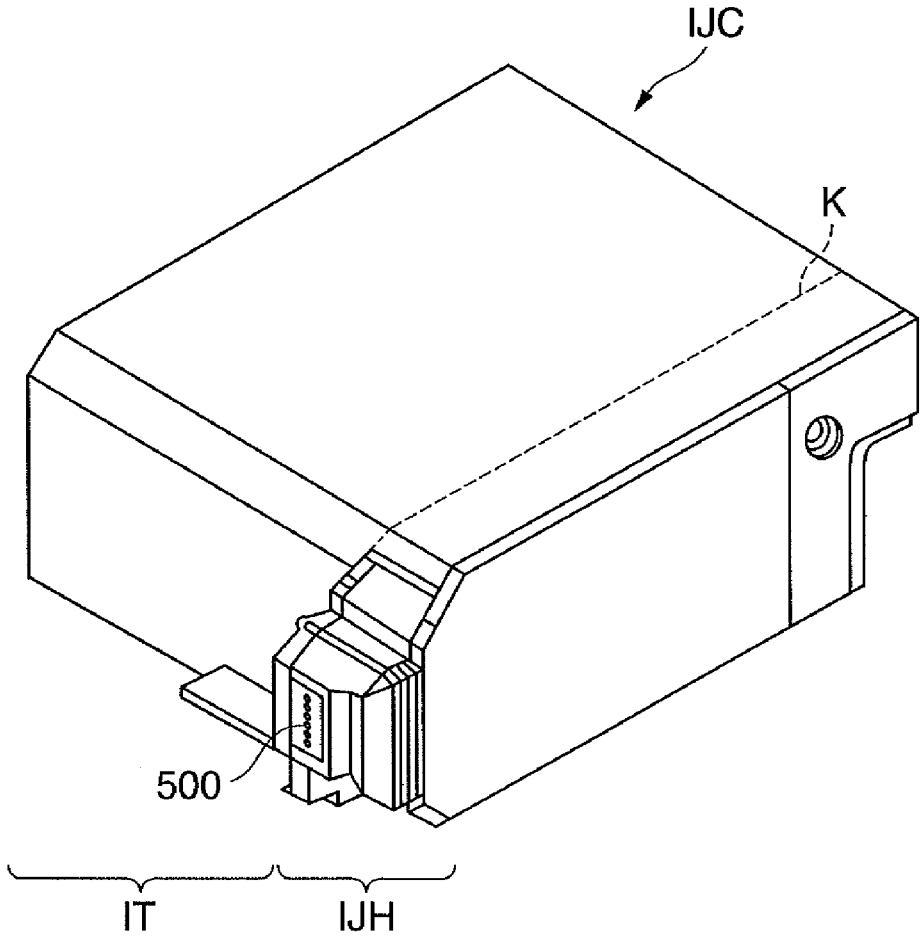
FIG. 3 is a perspective view showing the outer appearance of the structure of a head cartridge IJC which integrates an ink tank and printhead.

FIG. 3 is a perspective view showing the outer appearance of the structure of the head cartridge IJC which integrates the ink tank and printhead. In FIG. 3, a dotted line K indicates the boundary between an ink tank IT and a printhead IJH. The head cartridge IJC has an electrode (not shown) to receive an electrical signal supplied from the carriage 2 when the head cartridge IJC is mounted on the carriage 2. The electrical signal drives the printhead IJH to discharge ink, as described above.

In FIG. 3, reference numeral 500 denotes an ink orifice array. The ink tank IT has a fibrous or porous ink absorber for holding ink.

Figure 3A:
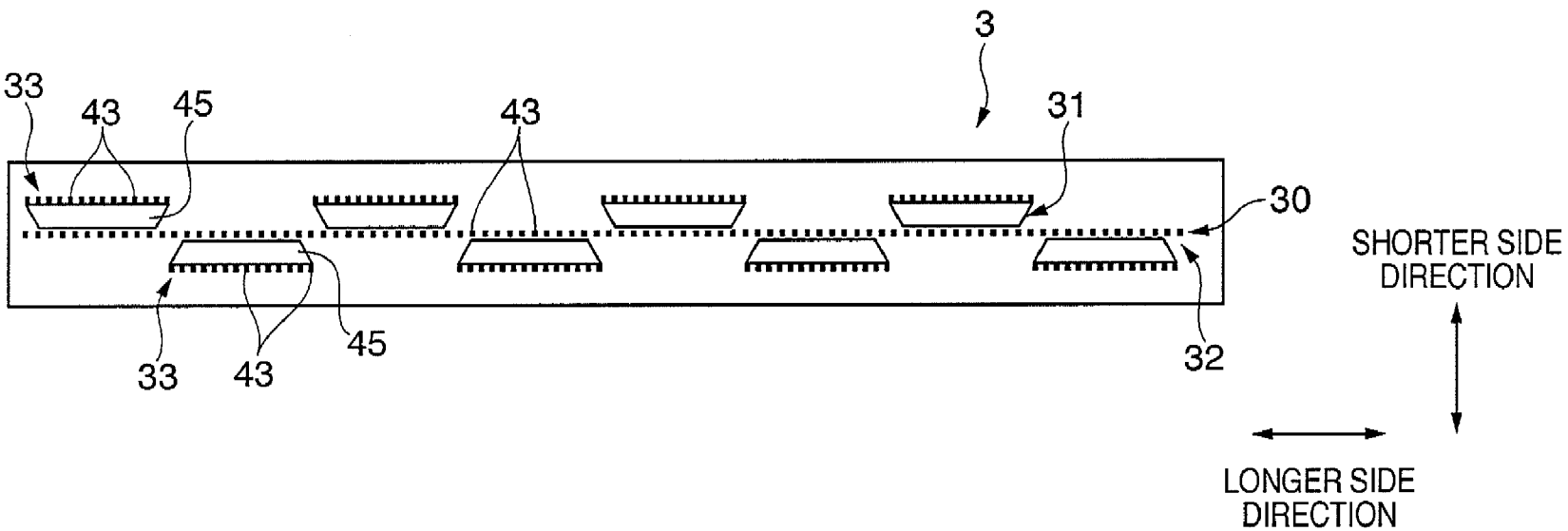
FIG. 3A is a plan view showing the ink discharge surface of a printhead 3.

FIG. 3A is a plan view showing the ink discharge surface of the printhead 3.

FIG. 3A shows an arrangement for discharging one kind of ink. To discharge a plurality of inks, the same arrangements as that shown in FIG. 3 are arranged by the number of inks in the carriage moving direction.

As shown in FIG. 3A, two ink supply channel arrays 31 and 32 are parallel-arranged along the longer side direction on the printhead 3. Each of the ink supply channel arrays 31 and 32 has ink supply channels 45 arrayed at predetermined intervals in the longer side direction of the printhead 3. Ink orifices 43 are formed at predetermined pitches on the two sides of each ink supply channel 45. Of the ink orifices, ink orifices positioned on the inner side of the printhead with respect to the shorter side direction of the printhead 3 form a first orifice array 30. Of the ink orifices, ink orifices positioned on the outer side of the printhead along the shorter side direction of the printhead 3 form a second orifice array 33.

In FIG. 3A, the first orifice array 30 looks straight. However, the ink orifices of the first orifice array need not always be formed straight. The ink orifices of the first orifice array are staggered every ink supply channel depending on the interval between the ink supply channel arrays 31 and 32 with respect to the shorter side direction of the printhead 3.

As described above, the ink supply channels of the printhead 3 according to the embodiment are staggered. Since the ink orifices are formed on the two sides of each ink supply channel, they are also staggered every ink supply channel.

<Layout of Head Substrate>

The layout of a head substrate assembled into the printhead mounted in the printing apparatus having the above-described arrangement will be described.

As a comparative example, a layout of a rectangular head substrate will be explained.

Figure 11:
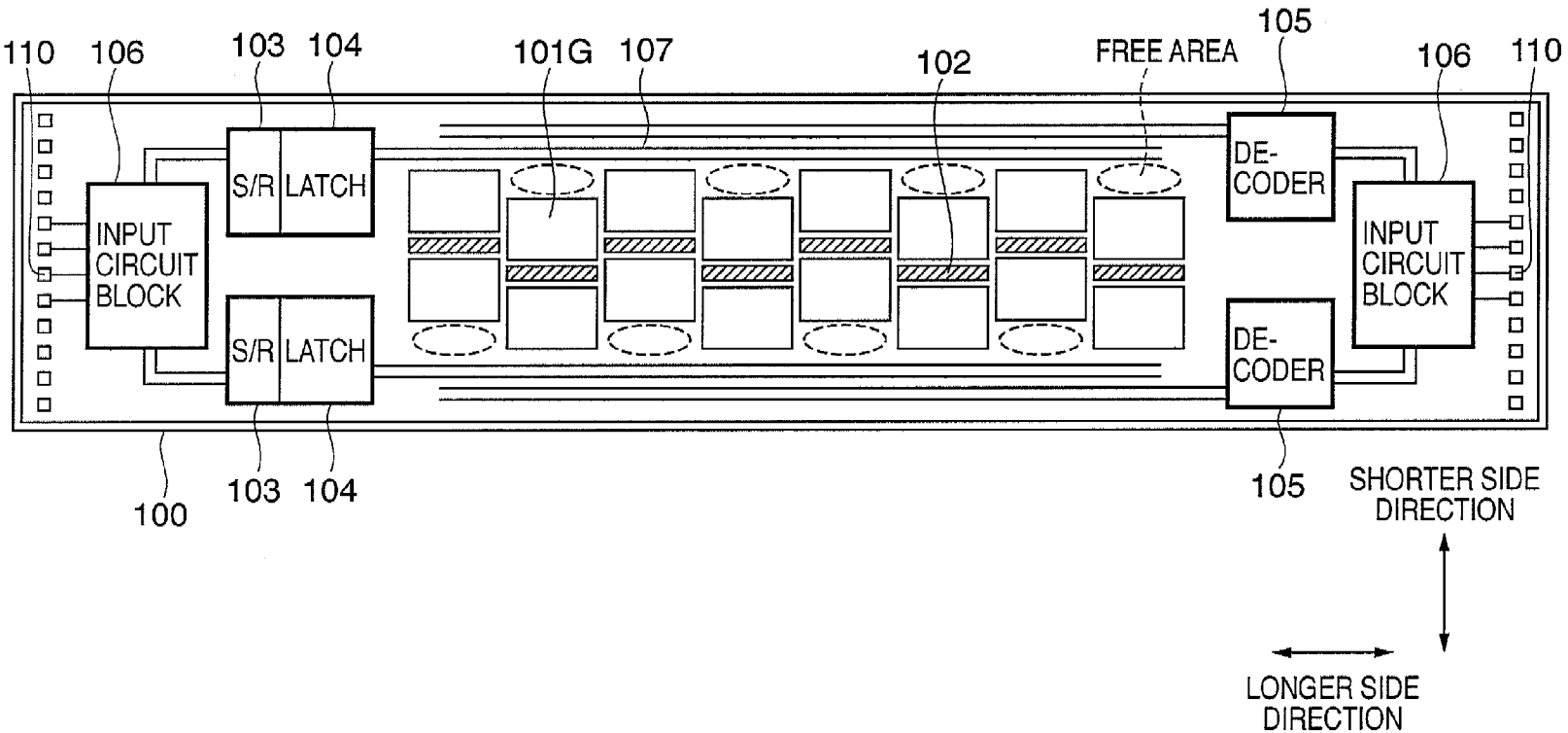
FIG. 11 is a view showing another layout of the head substrate as a comparative example.

FIG. 11 is a view showing the layout of the head substrate as the comparative example.

In this layout, pads 110 for electrical connection to the outside of the head substrate, input circuit blocks 106, shift registers 103, latch circuits 104, decoders 105, and the like are arranged at the ends of the head substrate in the longer side direction. This layout can suppress an increase in the size of the head substrate in the shorter side direction. Signal lines extending from the shift registers and latch circuits, and signal lines extending from the decoders are provided along the longer side direction of the head substrate.

Figure 6:
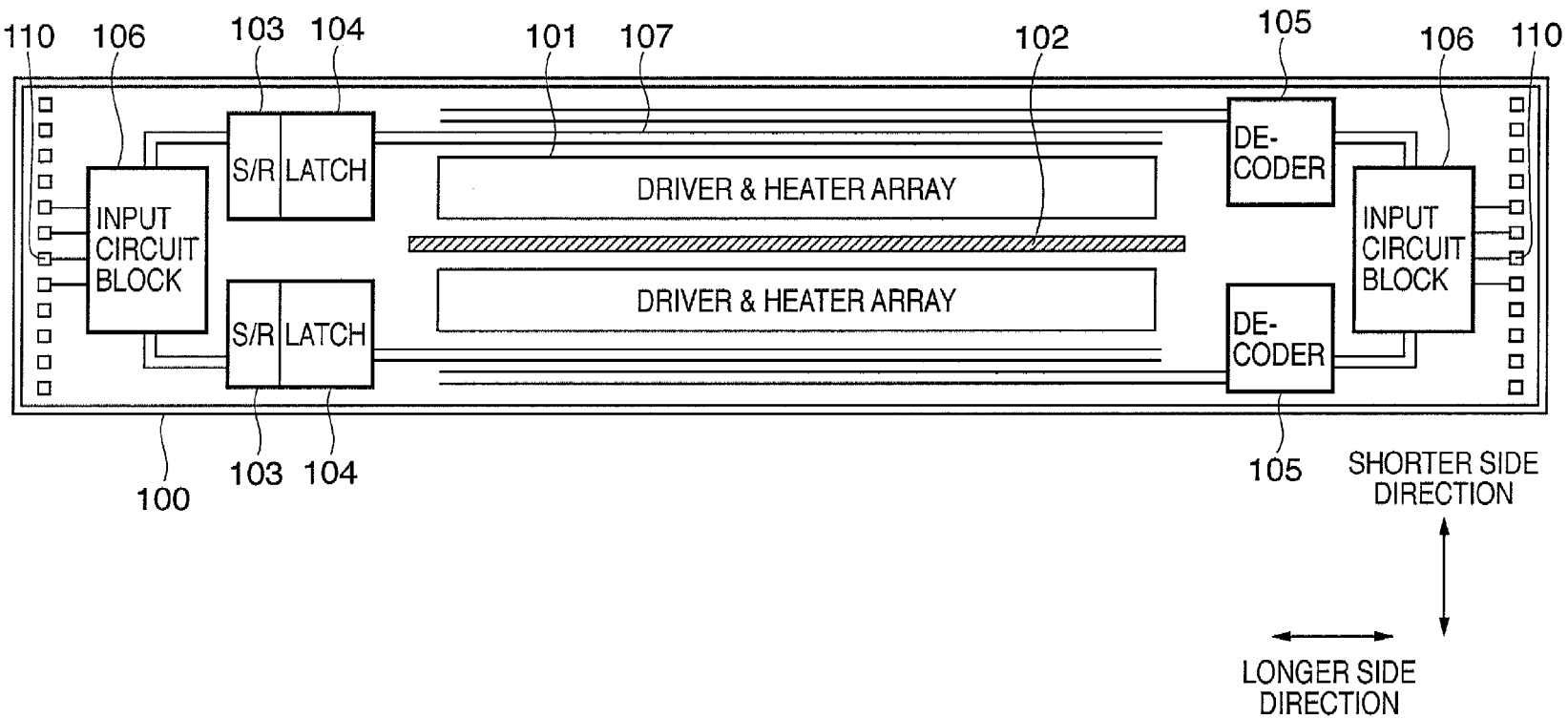
FIG. 6 is a view showing the layout of a head substrate according to a conventional art.

In the example shown in FIG. 11, ink supply channels 102 are divided for respective groups and arranged at positions offset from each other (this arrangement is called a staggered array). The staggered array is employed especially when the substrate needs to be made thin or when the chip becomes very narrow, in order to increase the mechanical strength of the head substrate. To the contrary, segment groups (element arrays) each including heaters (heater array) and driver transistors (driver array) need not always be staggered. In terms of the wiring and the arrangement of a diffusion layer formed in the head substrate, the segment groups are preferably parallel-arranged successively in the longer side direction of a chip, as shown in FIG. 6.

However, on the head substrate as shown in FIG. 11 on which sets of ink supply channels and groups 101G are staggered, a free area is created at a portion surrounded by two or three groups 101G and the signal line 107, as indicated by each broken line in FIG. 11. The free area cannot be effectively utilized and is unwanted.

To efficiently utilize such a free area, the embodiment proposes a new layout for the head substrate to arrange the building elements of the head substrate in the free area.

Figure 4:
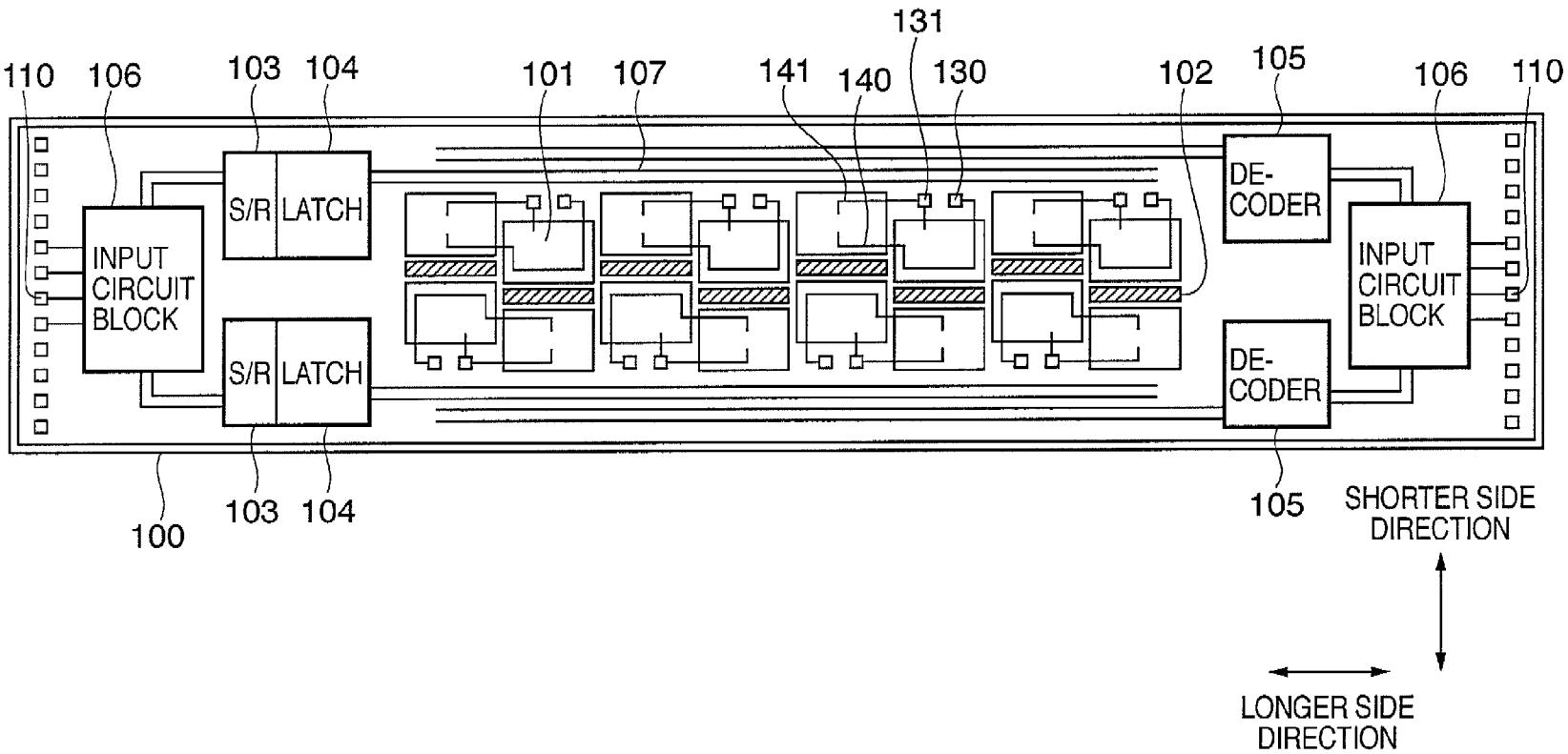
FIG. 4 is a view showing the layout of a head substrate according to an embodiment of the present invention.

FIG. 4 is a view showing the layout of the rectangular head substrate integrated into the printhead 3.

In FIG. 4, the same reference numerals as those in FIGS. 6 and 11 denote the same parts, and a description thereof will not be repeated. Only a characteristic arrangement of the layout shown in FIG. 4 will be explained.

In the layout shown in FIG. 4, the ink supply channels 102, groups 101G, and signal lines 107 are arranged in the order named from the ink supply channels 102 toward the longer side of the head substrate (along the shorter side direction).

Figure 10:
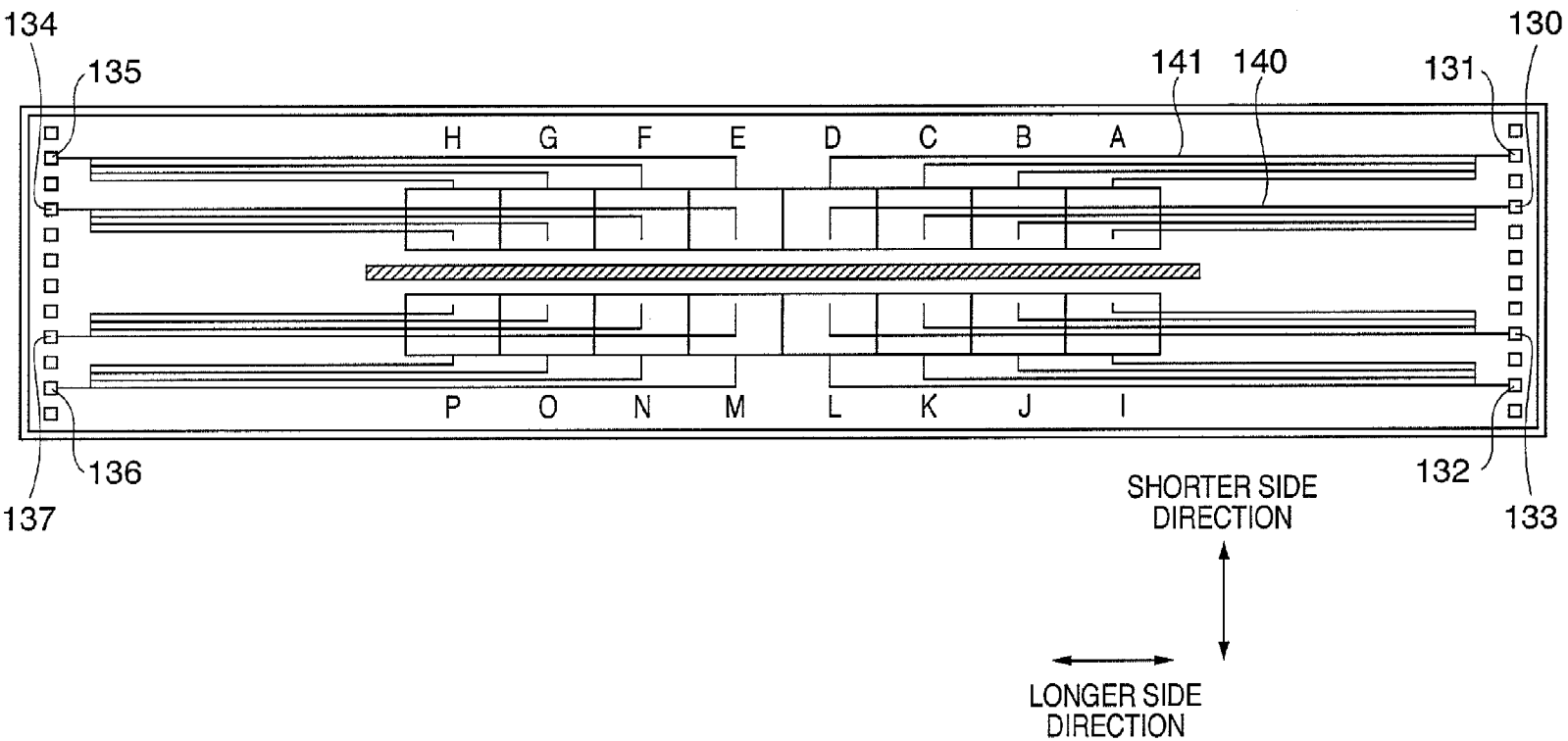
FIG. 10 is a view showing connection of power supply wiring lines in the head substrate shown in FIG. 6.

According to the embodiment, as is apparent from comparisons between FIG. 4, and FIG. 10 showing the conventional art and FIG. 11 showing the comparative example, a power supply pad VH 130 and a ground pad GND 131 corresponding to the power supply pad VH are arranged in each area which remains free on a conventional head substrate. Further, wiring lines are arranged to independently supply power to respective groups of a heater & driver array 101 from the power supply pad VH 130 and ground pad GND 131 which are arranged in the area which was used to be free on the conventional head substrate.

Figure 4A:
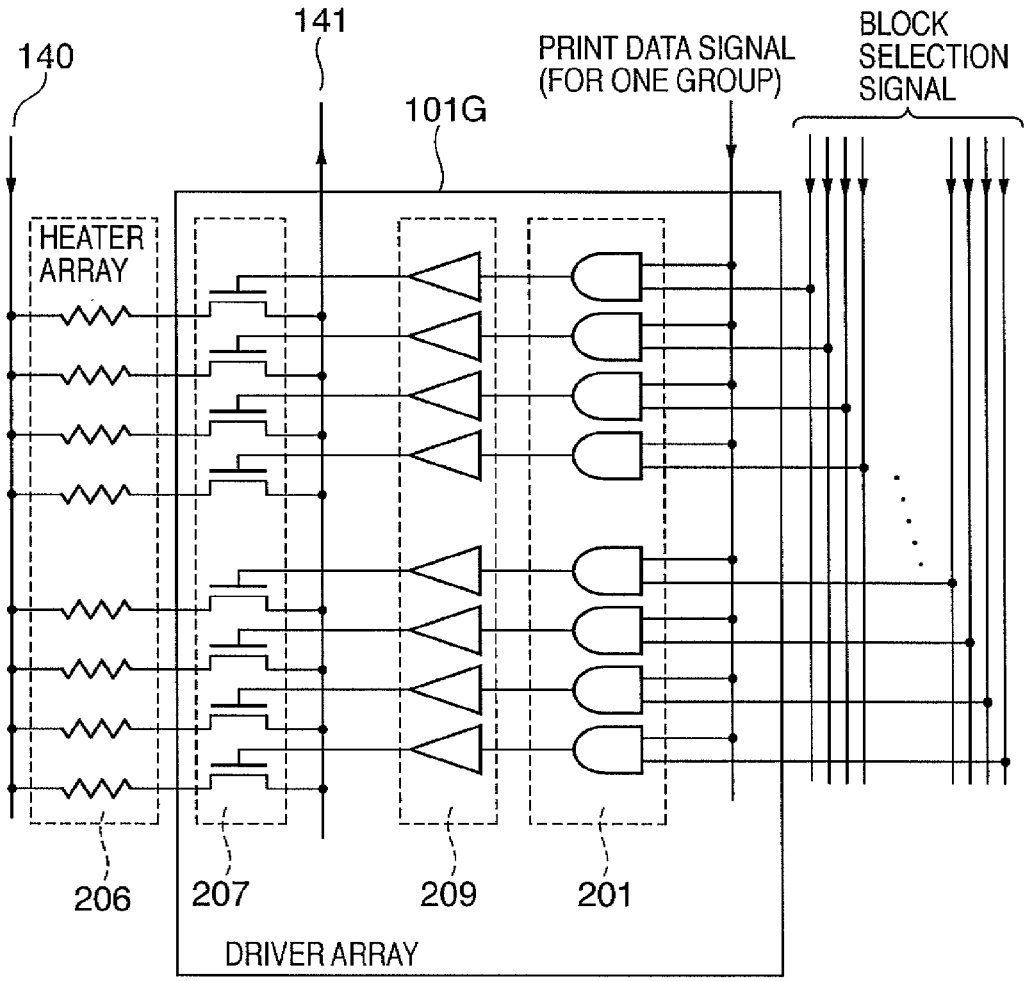

FIG. 4A is an equivalent circuit diagram showing the detailed arrangement of the group 101G including a heater array, driver array, and the like.

In FIG. 4A, a block selection signal and print data are input to an AND circuit 201 functioning as a heater selection circuit. When these two signals become active, an output from the AND circuit 201 becomes active. The circuit arrangement of the heater array and driver array in the group 101G in the embodiment is the same as that shown in FIG. 7.

Figure 7:
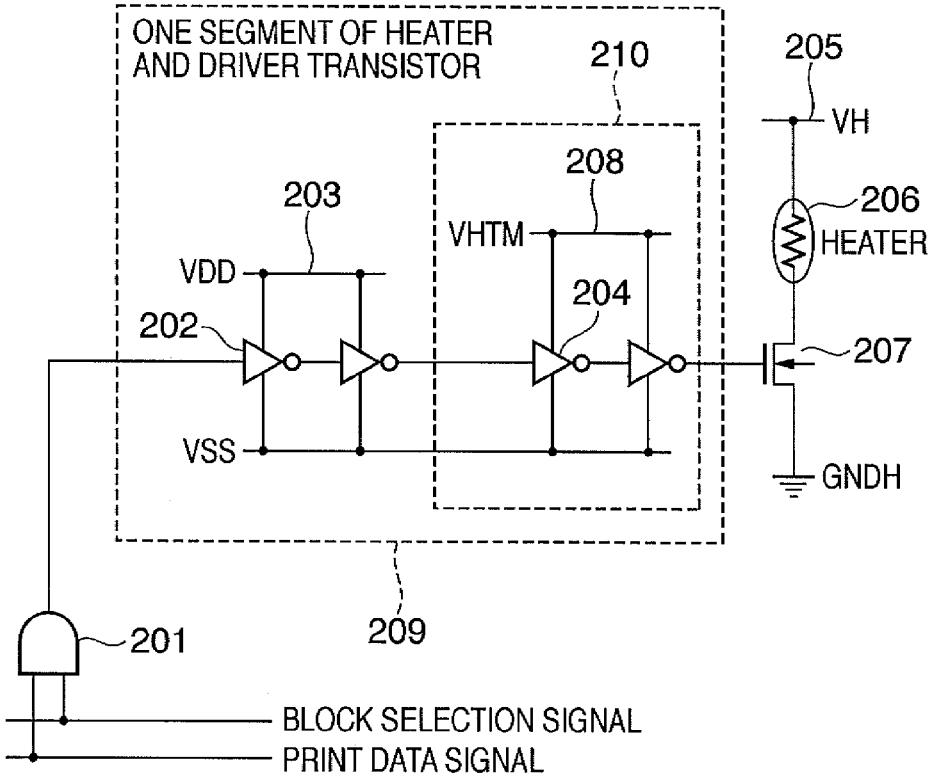
FIG. 7 is a circuit diagram showing an equivalent circuit corresponding to one segment of the heater & driver array 101 which is integrated on the head substrate shown in FIG. 6 and drives heaters for discharging ink.
Figure 8:
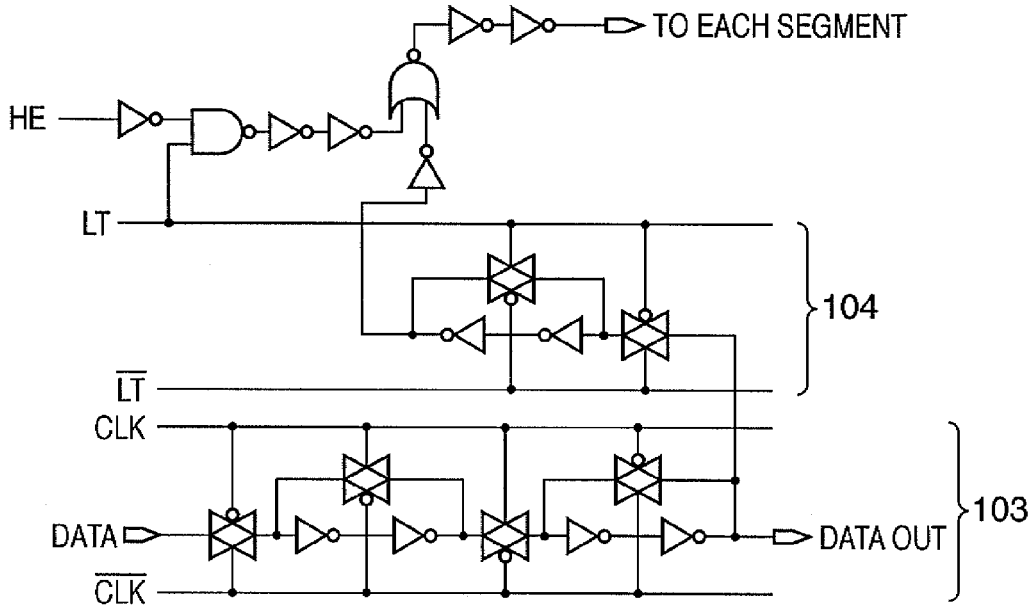
FIG. 8 is an equivalent circuit diagram of a circuit corresponding to one bit of a shift register 103 and latch circuit 104 which temporarily store print data.
Figure 9:
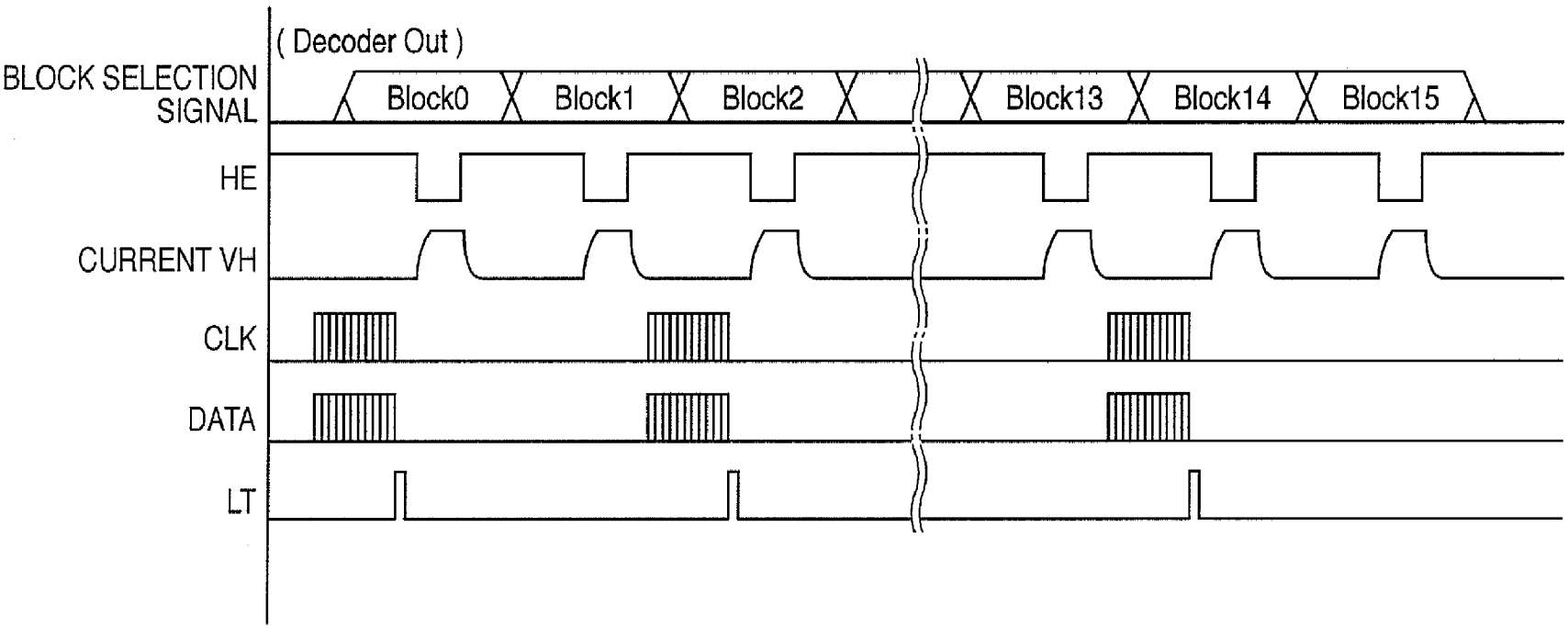
FIG. 9 is a timing chart for explaining a series of operations from receiving print data in the shift register 103 to driving the heater 206 by supplying a current to it.

A voltage conversion circuit 209 shown in FIG. 7 converts the voltage amplitude of an output signal from the AND circuit 201 to have a voltage VHTM higher than a voltage represented by the voltage amplitude VDD of an output from the AND circuit 201. The converted signal is supplied to the gate of a driver transistor 207 functioning as a driving element. As a result, a current is supplied to a heater 206 connected to the driver transistor 207 to which the voltage is applied at its gate, thereby driving the heater 206. One terminal of the heater 206 is connected to a VH power supply line 140 connected to a heater power supply pad VH 130. The source terminal of the driver transistor 207 is connected to a GNDH power supply line 141 connected to a ground pad GND 131.

Figure 4B:
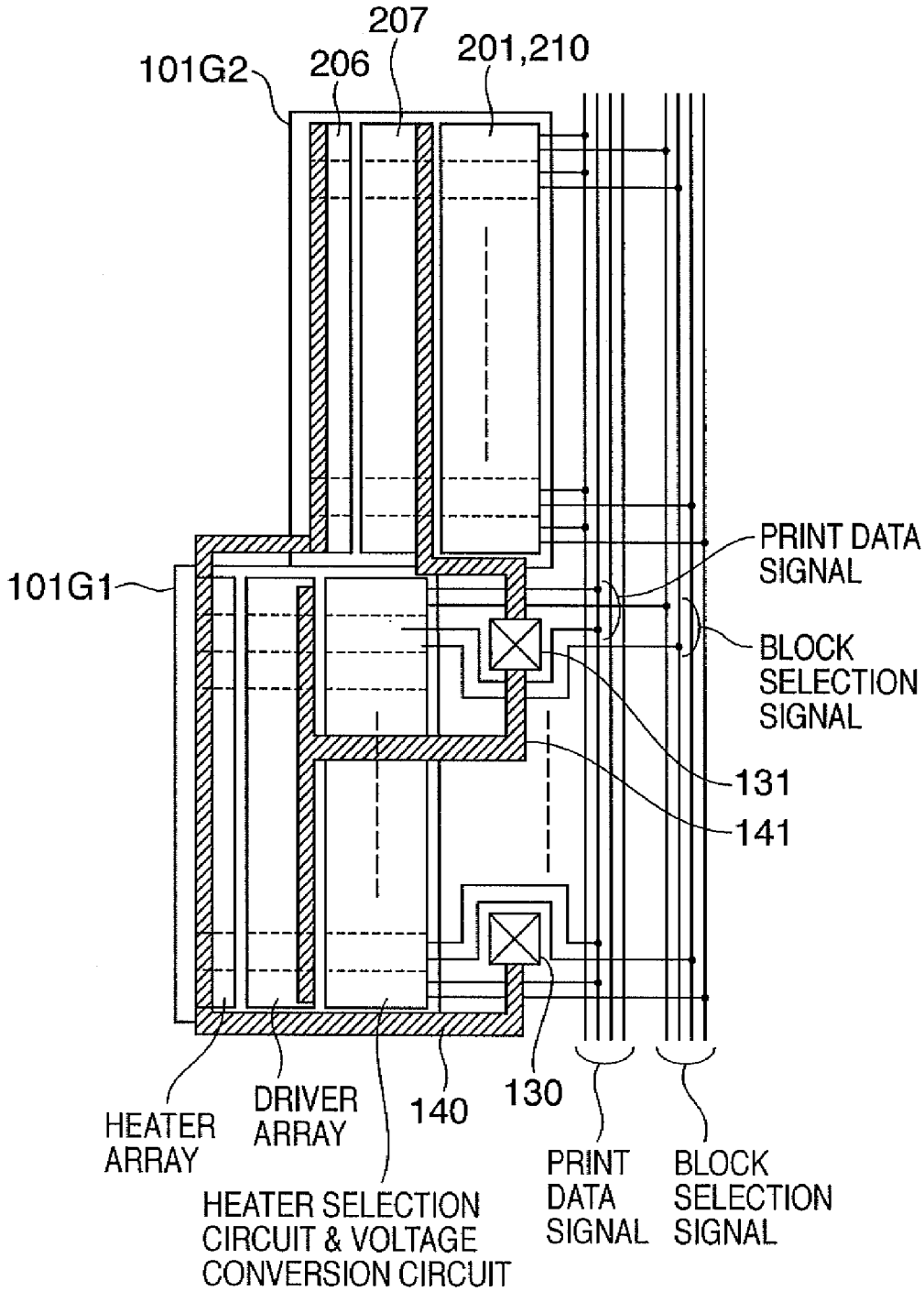
FIG. 4B is an enlarged view of part of FIG. 4 showing a more specific layout of two groups 101G1 and 101G2 and their periphery.

FIG. 4B is an enlarged view of part of FIG. 4 showing a more specific layout of two groups 101G1 and 101G2 and their periphery.

The power supply lines 140 and 141 hatched in FIG. 4B are connected to the heater power supply pad VH 130 and ground pad GND 131, respectively. These wiring lines are formed from interconnection layers of a metal such as Al, and formed on the driver transistor and heater selection circuit. The block selection signal and print data signal are input to each heater segment by providing the signal lines around the heater power supply pad VH 130 and ground pad GND 131.

According to the embodiment, the power supply pad VH and ground pad GND can be arranged in a free area formed by the staggered array on the conventional head substrate. In addition, wiring lines can be individually connected to the two adjacent groups 101G1 and 101G2, as shown in FIG. 4B, shortening the wiring length.

The connection of wiring lines from the power supply pad VH and ground pad GND is not limited to the arrangement shown in FIG. 4. The same effects can also be achieved by, e.g., a connection arrangement as shown in FIG. 5.

Figure 5:
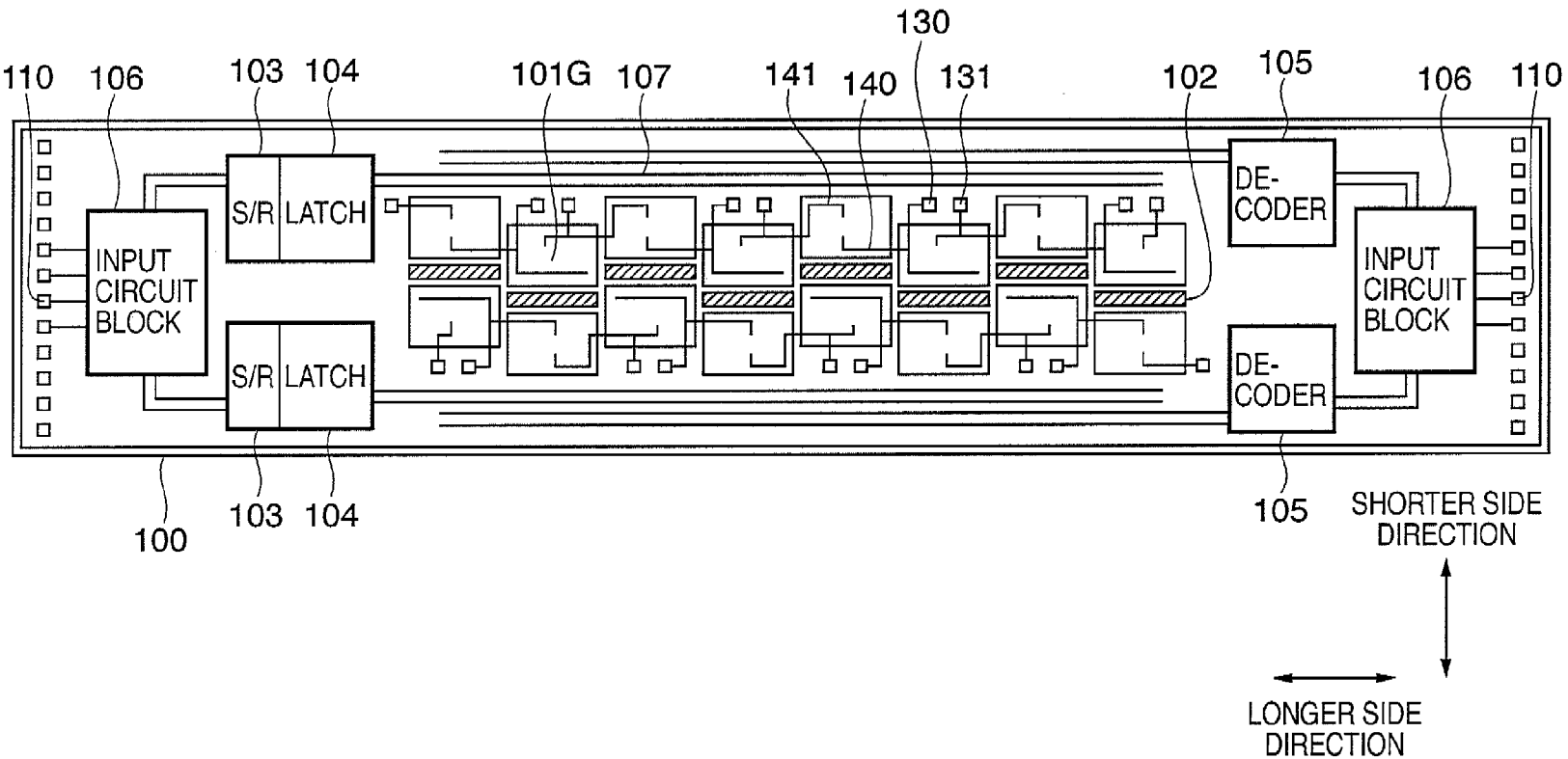
FIG. 5 is a view showing another layout of the head substrate according to the embodiment of the present invention.

FIG. 5 is a view showing another layout of the head substrate integrated into the printhead 3.

Also in FIG. 5, the same reference numerals as those in FIGS. 6 and 11 denote the same parts, and a description thereof will not be repeated.

In FIG. 5, VH and GNDH wiring lines to two adjacent groups are designed to have almost the same wiring length from VH and GNDH pads for the two adjacent groups. The layout as shown in FIG. 5 can make almost uniform the resistances of the wiring lines extending from the VH and GNDH pads to two adjacent groups. The wiring length can be shortened to reduce power loss. Wiring lines can be made uniform between groups to minimize the negative influence of power loss.

Figure 5A:
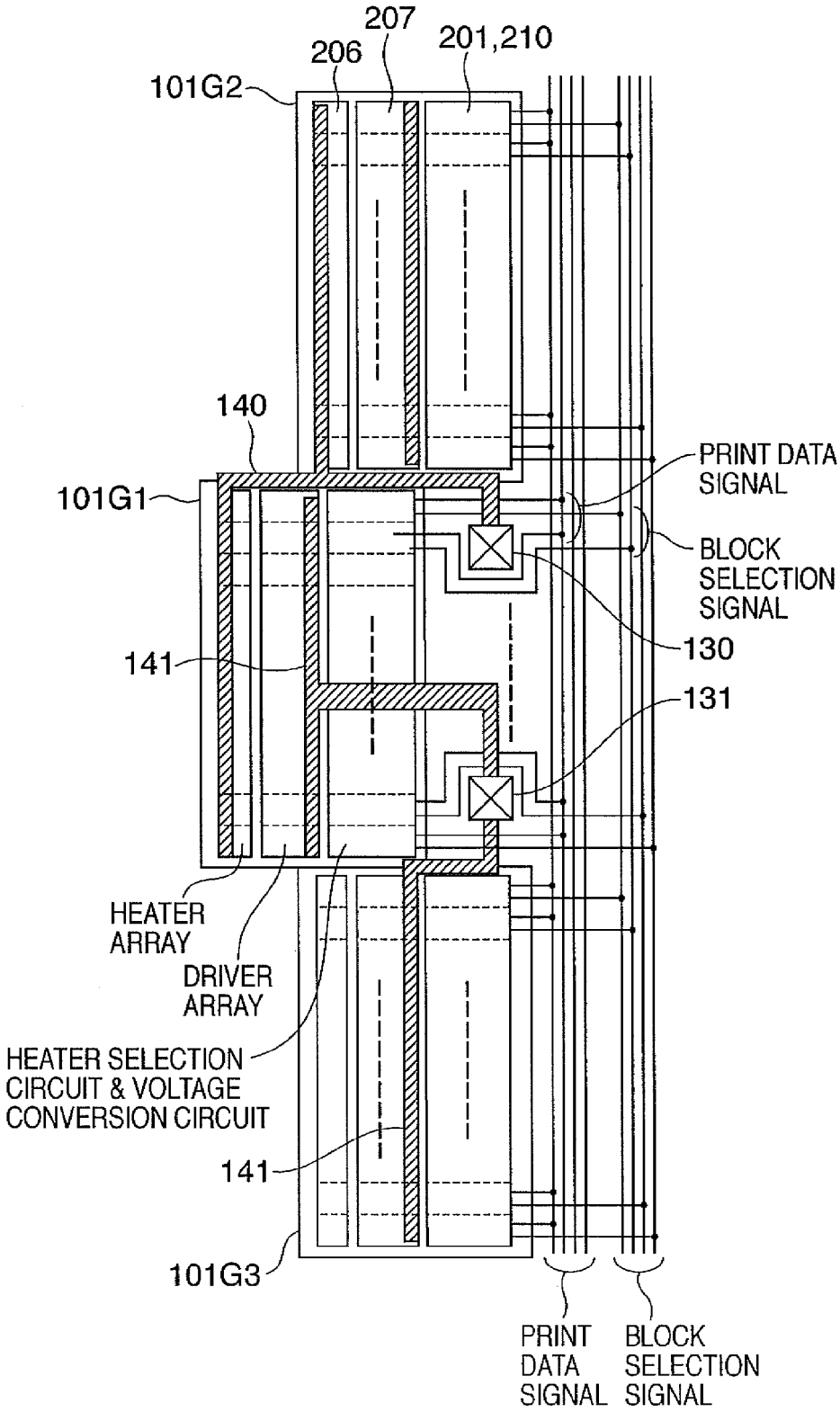
FIG. 5A is an enlarged view of part of FIG. 5 showing a more specific layout of three groups 101G1, 101G2, and 101G3 and their periphery.

FIG. 5A is an enlarged view of part of FIG. 5 showing a more specific layout of three groups 101G1, 101G2, and 101G3 and their periphery. Also in FIG. 5A, the same reference numerals as those in FIG. 4A denote the same parts, and a description thereof will not be repeated.

Also in FIG. 5A, the hatched power supply lines 140 and 141 are connected to the heater power supply pad VH 130 and ground pad GND 131, respectively. These wiring lines are formed from interconnection layers of a metal such as Al, and formed on the switching element and heater selection circuit. The block selection signal and print data signal are input to each heater segment by providing the signal lines around the heater power supply pad VH 130 and ground pad GND 131.

When a through-hole electrode is employed in each of the layouts shown in FIGS. 4 and 5, it allows electrical connection to the power supply pad VH and ground pad GND from the back surface of the substrate. This contributes to further increasing the layout efficiency of the entire head substrate, and downsizing the head substrate.

Figure 5B:
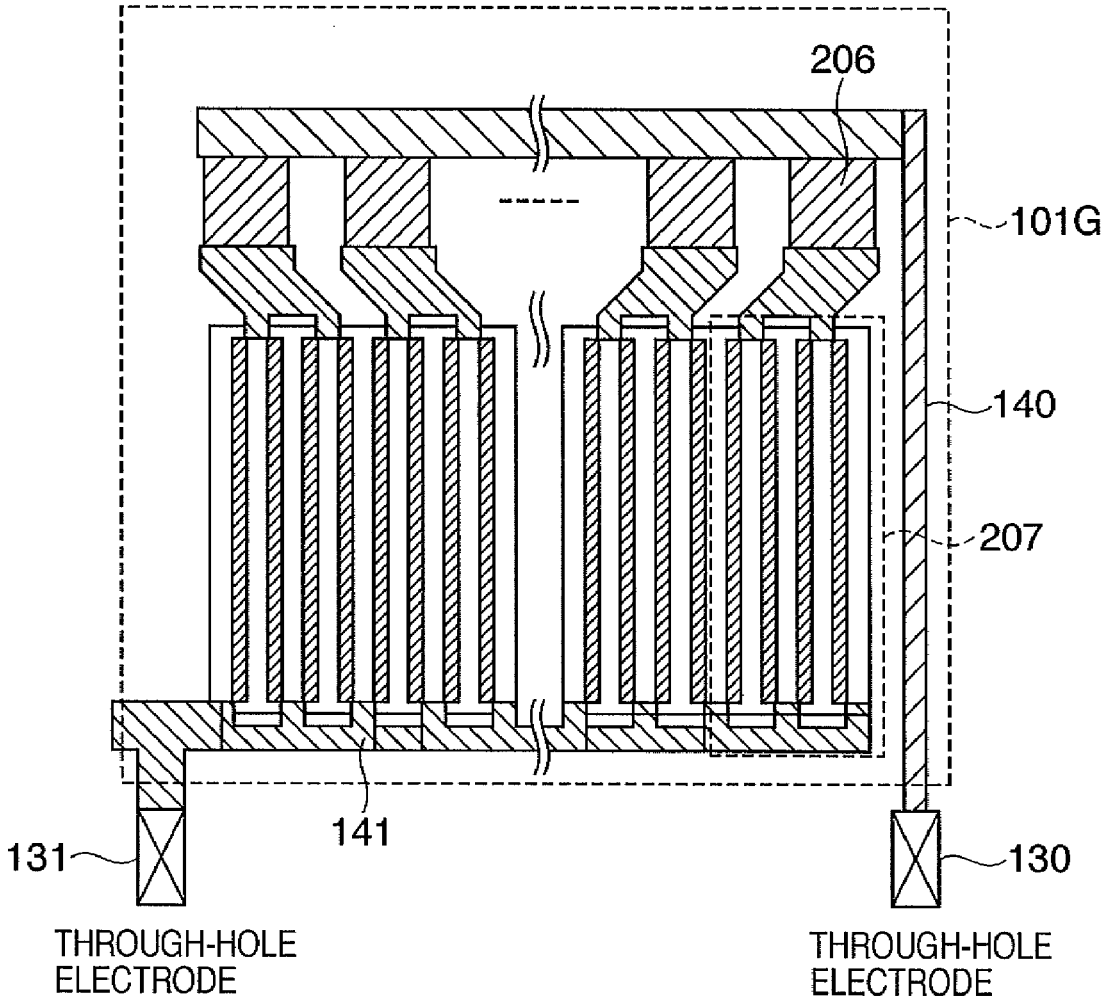
FIG. 5B is a view showing the layout of a head substrate using a through-hole electrode.

FIG. 5B is a view showing the layout of the head substrate using the through-hole electrode.

As shown in FIG. 5B, one terminal of the heater 206 is connected to the VH power supply line 140 connected to the heater power supply pad VH 130 formed from a through-hole electrode. The source terminal of the driver transistor 207 is connected to the GNDH power supply line 141 connected to the ground pad GND 131 formed from a through-hole electrode. The through-hole electrode means an electrode which connects an electrode to the back surface of a substrate via a hole extending through the substrate.

Figure 5C:
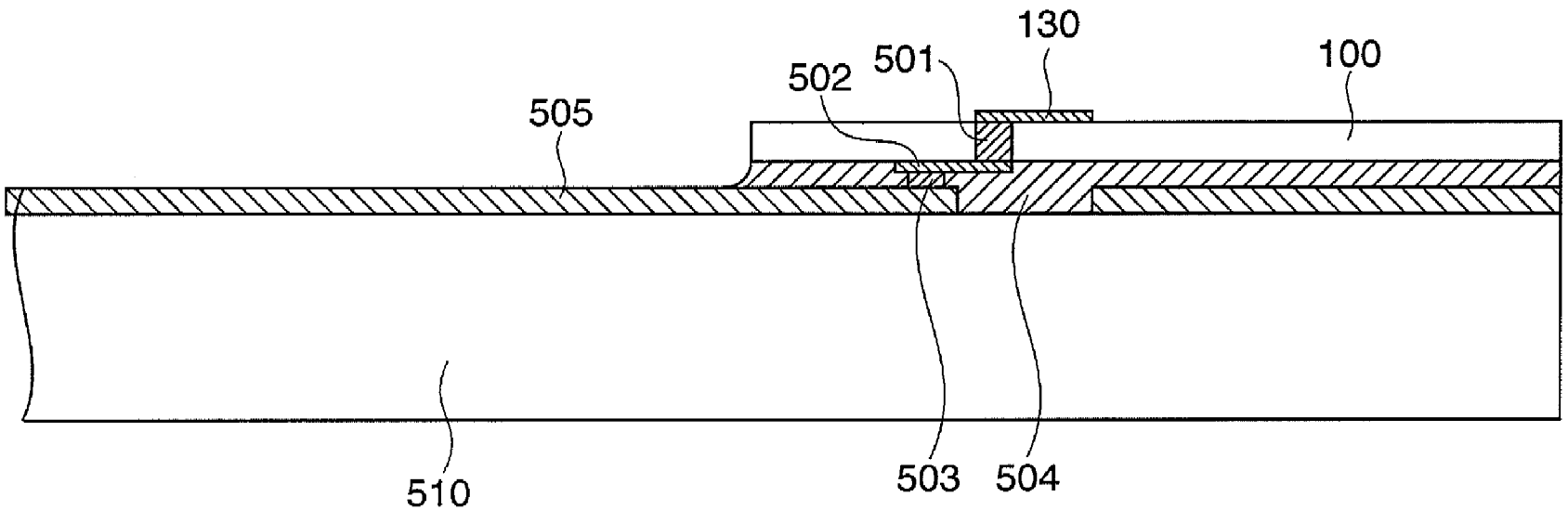
FIG. 5C is a sectional view showing the form of backside mounting using a through-hole electrode formed in a substrate.

FIG. 5C is a sectional view showing the form of so-called backside mounting in which a wiring line extends to the back surface of a substrate via a through-hole electrode formed in the substrate, and is connected to a member for connecting an external wiring line such as a flexible cable substrate.

As shown in FIG. 5C, the heater power supply pad VH 130 is connected to a through-hole electrode 501, and connected via the through-hole electrode 501 to another pad 502 formed on the back surface of the substrate 100. The pad 502 has a bump 503. The pad 502 is connected via the bump 503 to a wiring line 505 provided on a flexible cable 510. In this way, the heater power supply pad VH 130 is connected via the through-hole electrode 501 to the flexible cable substrate 510 serving as an external wiring line. An insulating member 504 is inserted between the substrate 100 and the flexible cable substrate 510.

This layout allows connecting a power supply wiring line to the back surface of a substrate and directly to an external electrode. This contributes to further decreasing wiring resistance, and greatly enhancing the effects of the present invention.

Other than the illustrated power supply pad and ground pad, a VHT buffer, voltage conversion circuit, and the like may also be arranged in the free area.

A converted voltage generator serving as a circuit which internally generates a voltage for driving a driver transistor is made up of a VHT buffer, and a dividing resistor unit which generates the gate voltage of a transistor serving as the buffer.

Figure 5D:
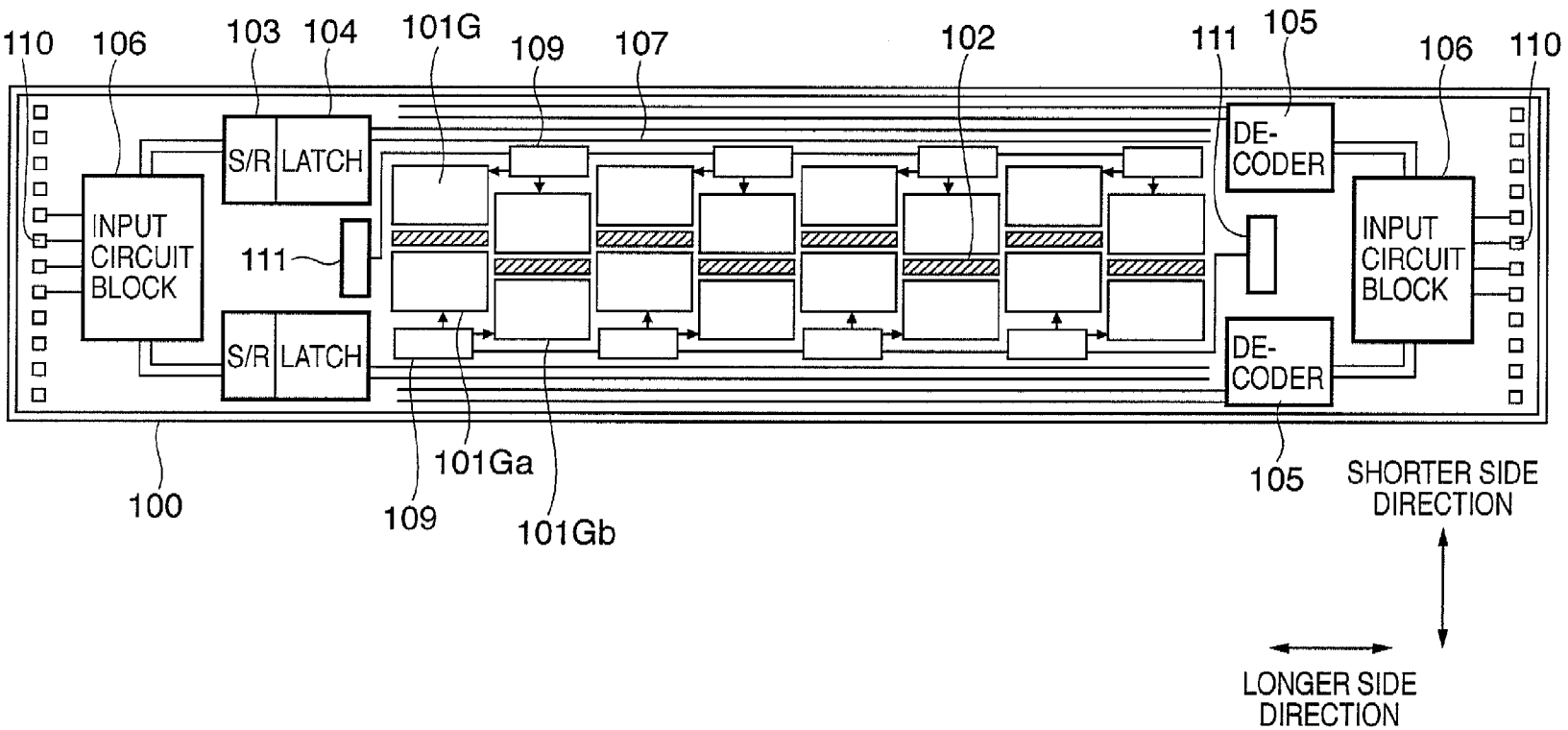
FIG. 5D is a view showing a layout when a VHT buffer is arranged in a free area formed by a staggered array.

FIG. 5D is a view showing a layout when the VHT buffer is arranged in a free area formed by the staggered array. The same reference numerals as those described above denote the same parts, and a description thereof will not be repeated. Only a characteristic arrangement of the layout shown in FIG. 5D will be explained.

In FIG. 5D, reference numeral 109 denotes a VHT buffer; and 111, a dividing resistor unit.

In this layout, the VHT buffer 109 can be arranged in a free area formed by the staggered array. One VHT buffer can apply a voltage to two adjacent groups 101Ga and 101Gb.

Figure 5E:
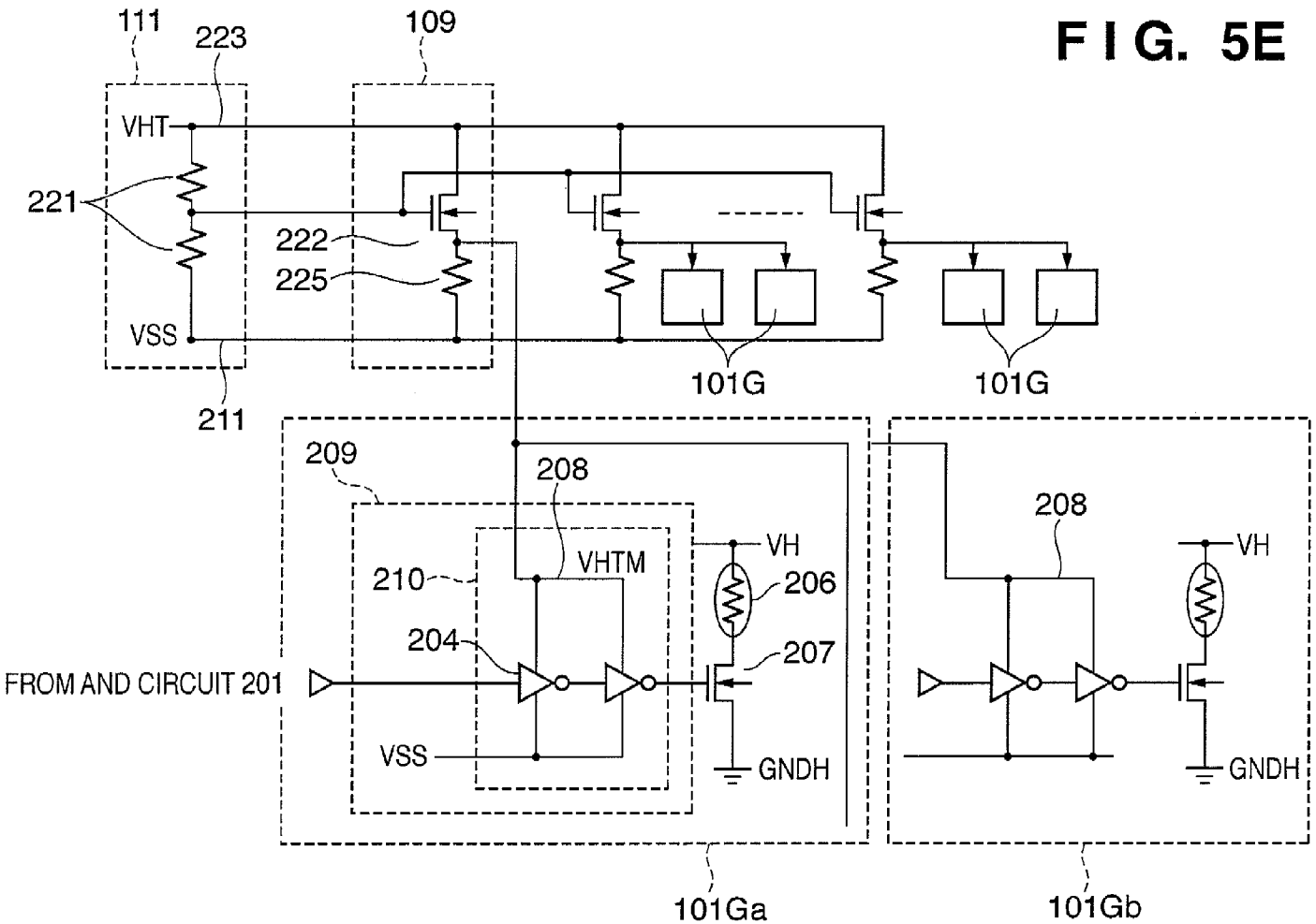
FIG. 5E is an equivalent circuit diagram for explaining in more detail a converted voltage generator and driver array in FIG. 5D.

FIG. 5E is an equivalent circuit diagram for explaining in more detail the converted voltage generator and driver array in FIG. 5D. The same reference numerals as those described above denote the same parts, and a description thereof will not be repeated.

In this layout, the converted voltage generator is divided into the dividing resistor unit 111 and VHT buffer 109. The VHT buffer 109 is arranged in a free area formed by the staggered array, and applies the voltage VHTM to two adjacent groups.

The VHT buffer 109 shown in FIG. 5E operates as a circuit using a source follower. The VHT buffer 109 includes an n-MOS transistor 222 serving as a buffer, and a resistor 225 serving as the load of the source follower. The dividing resistor unit 111 includes two dividing resistors 221 for determining the gate voltage of the n-MOS transistor 222. A VHT power supply line 223 is the source of the VHTM power supply voltage in the converted voltage generator. A VSS line 211 provides the GND potential of these circuits.

The operation of this circuit arrangement will be explained in more detail. A voltage applied to the gate of the n-MOS transistor 222 is set to a desired value by the dividing resistors 221, determining the voltage VHTM of an output from the source follower. The voltage VHTM is applied to the groups 101Ga and 101Gb.

In each of the groups 101Ga and 101Gb, the voltage conversion circuit 209 converts a signal from the heater selection circuit by converting the amplitude voltage VDD of the signal output pulse of the AND circuit 201 into the voltage VHTM for driving the gate of the driver transistor. The gate of the driver transistor 207 is driven at a voltage higher than one represented by the signal output amplitude of the AND circuit 201. Thus, the ON resistance of the driver transistor decreases, and the heater driving energy efficiency increases.

This layout can reduce the influence of a voltage drop by the wiring resistance, the influence of noise which comes into the wiring line, and the like, as compared with a case where VHT buffers are arranged at one portion on a substrate and supply power to groups via wiring lines.

Note that the total number of segment groups including heaters and driver transistors is 16 in the above description, but the present invention is not limited to this. The effects of the present invention can be similarly obtained regardless of the number of segment groups.

In the above-described embodiments, droplets discharged from the printhead are ink, and the liquid contained in the ink tank is ink. However, the content is not limited to ink. For example, the ink tank may also contain a process liquid which is discharged to a print medium in order to improve the fixing characteristic and water repellency of a printed image and improve the print quality.

In the above-described embodiments, high print density and high resolution can be achieved by, of inkjet printing methods, a method of changing the ink state by heat energy generated by a means (e.g., electrothermal transducer) for generating heat energy to discharge ink.

In addition, the inkjet printing apparatus according to the present invention may also take the form of an image output apparatus for an information processing apparatus such as a computer, the form of a copying apparatus combined with a reader or the like, and the form of a facsimile apparatus having transmission and reception functions.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-328852, filed Dec. 5, 2006, which is hereby incorporated by reference herein in its entirety.

What is claimed is:

1. A rectangular head substrate used in an inkjet printhead having a printing element array of printing elements which print by discharging ink, and a driving element array of driving elements which drive the printing elements, the head substrate comprising:

a plurality of ink supply channels having a predetermined length along a longer side direction of the head substrate;

a plurality of element arrays which are arranged on at least one side of each of the plurality of ink supply channels, and each of which has the printing element array and the driving element array; and a signal line which is provided along the longer side direction of the head substrate and transmits a signal to said plurality of element arrays, wherein said element arrays and said signal line are provided in an order named from the plurality of ink supply channels toward a longer side of the head substrate, plural pairs of the ink supply channels and said element arrays corresponding to the respective ink supply channels are arrayed in a staggered manner in the longer side direction of the head substrate, and another building element, of the head substrate, electrically connected to two adjacent element arrays is arranged in an area surrounded by said signal line and every other element array out of said plurality of element arrays arranged in the staggered manner.

2. The head substrate according to claim 1, wherein said another building element includes two types of pads used for connection to outside of the head substrate, one of the two types of pads being a power supply pad for supplying power to the printing element array, and the other of the two pads being a ground pad for feeding back power supplied to the printing element array.

3. The head substrate according to claim 2, wherein each of the power supply pad and the ground pad is connected to two adjacent common element arrays.

4. The head substrate according to claim 2, wherein one element array out of two adjacent element arrays connected to the power supply pad, and one element array out of two adjacent element arrays connected to the ground pad are common.

5. The head substrate according to claim 2, wherein the power supply pad and the ground pad are arranged on a surface opposite to a surface having said plurality of element arrays, and are electrically connected to said plurality of element arrays via through-holes extending through the head substrate.

6. The head substrate according to claim 2, wherein input pads which input print data and a control signal for driving the printing elements, and a control circuit which drives and controls the plurality of driving elements based on the print data and control signal input from the input pads are arranged at an end of the head substrate along a longer side direction, and the print data and the control signal are supplied via said signal line.

7. The head substrate according to claim 6, wherein the control circuit includes:

a shift register which temporarily stores print data input from the input pads;

a latch circuit which latches the print data stored in the shift register and outputs a print data signal; and a decoder which receives the control signal input from the input pad and generates a signal for selecting and driving the plurality of printing elements.

8. The head substrate according to claim 7, wherein the input pads are arranged at two ends of the head substrate along the longer side direction, print data is input from an input pad arranged at one end out of the two ends, and the control signal is input from an input pad arranged at the other end out of the two ends.

9. The head substrate according to claim 8, wherein the shift register and the latch circuit are arranged on a side on which the input pad for inputting the print data is arranged, and the decoder is arranged on a side on which the input pad for inputting the control signal is arranged.

10. The head substrate according to claim 1, further comprising a voltage conversion circuit which converts a voltage of a signal transmitted to said plurality of element arrays into a voltage for driving the plurality of driving elements, wherein said another building element includes a VHT buffer which generates a voltage to be applied to said voltage conversion circuit.

11. The head substrate according to claim 1, wherein said element arrays are arranged on two sides of each of the plurality of ink supply channels.

12. The head substrate according to claim 1, wherein each of the plurality of printing elements includes an electrothermal transducer which generates heat energy used to discharge ink.

13. A printhead using a head substrate according to claim 1.

14. A head cartridge integrating a printhead according to claim 13 and an ink tank containing ink to be supplied to the printhead.

15. A printing apparatus using a printhead according to claim 13.

* * * * *